United States Patent [19]

White et al.

[11] Patent Number: 4,547,033

[45] Date of Patent: Oct. 15, 1985

[54] ELECTRICAL TAP CONNECTOR

[75] Inventors: Wayne White, Hillside; Jim Williams, Lombard, both of Ill.

[73] Assignee: Whisco Component Engineering, Inc., Elk Grove Village, Ill.

[21] Appl. No.: 649,133

[22] Filed: Sep. 10, 1984

[51] Int. Cl.[4] ..... H01R 9/08

[52] U.S. Cl. ..... 339/97 R

[58] Field of Search ..... 339/97 R, 97 P, 98, 339/99 R

[56] References Cited

U.S. PATENT DOCUMENTS 2,110,513 3/1938 Toelke ..... 339/99 R 2,344,766 3/1944 Deakin ..... 339/99 R

*Primary Examiner*—Joseph H. McGlynn

*Attorney, Agent, or Firm*—Van Epps, Robert F.

[57] ABSTRACT

An electrical tap connector for making an electrical connection to an insulation covered cable at a point remote from the ends thereof. An insulative cable retaining body is provided with a conductive insulation piercing cable tap which extends from the body to form an electrical accessory lug.

2 Claims, 3 Drawing Figures

ELECTRICAL TAP CONNECTOR

BACKGROUND OF THE INVENTION

1. Field of the Invention

The present invention relates generally to the field of electrical connectors and more particularly to an improved connector for tapping power from an insulated electrical conductor.

2. Description of the Prior Art

Prior to the present invention a variety of connectors for tapping power from insulated cables have been devised, many of which have application in the installation of accessory devices on vehicles or machines. Typical of the prior art in the field are those disclosed in U.S. Pat. Nos. 3,320,385, which issued in H. A. Sherwood on May 16, 1967 and 3,191,139, which issued on June 22, 1965 to A. Schiffmann. Another such connector is the Battery Tap which is the trademarked product of the assignee of the present application.

The tap connectors of the prior art are generally not well suited for use where load currents are below twenty five amperes. Those which are useful in the lower current applications are typically of relatively complex construction and thus expensive to manufacture as well as awkward to handle for installation in close quarters.

OBJECT AND SUMMARY OF THE INVENTION

From the preceding discussion it will be understood that among the various objectives of the present invention are included the following:

the provision of new and improved electrical tap connector;

the provision of an apparatus of the above-described character useful for low current applications; and the provision of an apparatus of the above-described character which is of a simplified construction.

These and other objectives of the present invention are efficiently achieved by providing an insulative cable retaining body of a generally u-shaped configuration. A conductive insulation cable tap extends at one end through one leg of the body to form an accessory lug and the other end is fixed to the opposite leg of the body.

The foregoing as well as other objects, features and advantages of the present invention will become more readily understood from the following detailed description taken in conjunction with the various views of appended drawings.

DESCRIPTION OF PREFERRED EMBODIMENT

Figure 1:
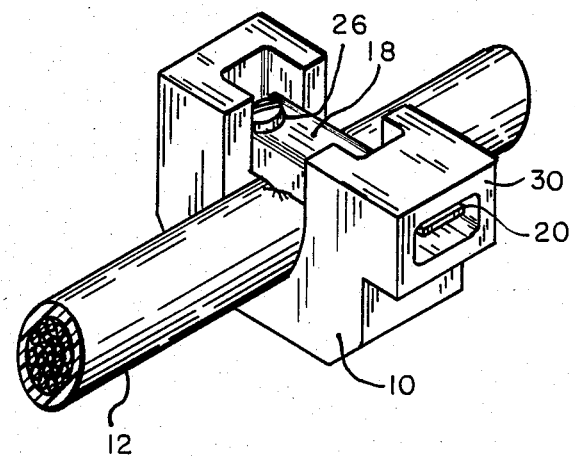
FIG. 1 is a perspective view of a cable connector in accordance with the principles of the present invention.
Figure 2:
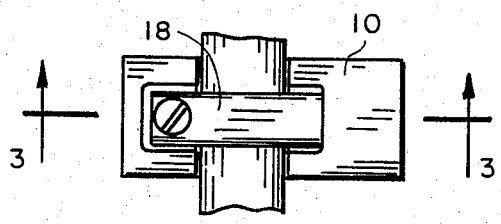
FIG. 2 is a top elevation view of the connector of FIG. 1.
Figure 3:
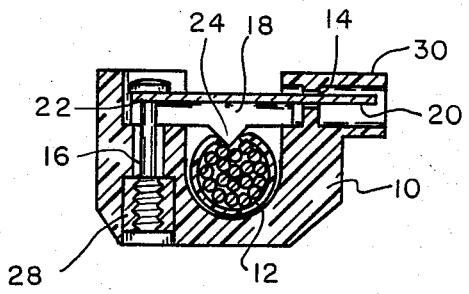
FIG. 3 is a cross section view of the connector of FIGS. 1 and 2.

With reference now to FIGS. 1–3 there is illustrated an electrical tap connector in accordance with the principles of the present invention. A generally u-shaped insulative body 10 is adapted to receive an insulated electrical cable 12 from which electric current is to be tapped. The primary application of the present invention is to tap power for various accessories from the battery cable of motor vehicles. The tap body 10 is placed on the cable 12 at any convenient point intermediate the ends thereof. The body 10 has an aperture or slot 14 adjacent the upper end of one leg and a recessed threaded aperture 16 through the opposite leg.

An insulation piercing electrically conductive tap 18 is formed to provide an accessory lug 20 at one end and has a screw receiving aperture 22 at the opposite end. The center portion of the tap 18 is of an open rectangular configuration and is provided at each side with pointed projections 24.

The device is assembled by placing the electrical cable 12 in the tap body 10 and inserting the accessory lug end 20 of the tap 18 through the slot 14. A screw 26 is inserted through the aperture 22 in the tap 18 and treaded into the tap body aperture 16. In practice the threads are provided by an internally threaded metal socket 28 which is press-fit into the aperture 16 and more resistant to stripping than the insulative material itself.

As the screw 26 is tightened against the tap 18 the latter is drawn down against the cable 12 until the projections 24 pierce the cable insulation and make contact with the electrical conductors.

In the preferred embodiment the tap body 10 is formed with a hollow lateral projection 30 into which the accessory lug 20 extends. The accessory may then easily be connected to the lug 20 by a flat sliding female connector (not shown) of the type commonly known in the art. The accessory may also be disconnected easily leaving the lug 20 in a protected insulated environment.

The electrical tap connector of the present invention is thus formed of a minimum number of parts, provides a quick connect/disconnect accessory lug, and is simple to install with minimum cable insulation damage. Since certain changes in the above-described construction will occur to those skilled in the art without departure from the scope of the invention it is intended that all matter set forth in the above description or shown in the appended drawings be deemed illustrative and not in a limiting sense.

Having described what is new and novel and desired to secure by Letters Patent, what is claimed is:

1. A connector for tapping electrical current from an insulated electrical cable at a point intermediate the ends of said cable, said connector comprising a connector body formed of an electrically insulative material of a u-shaped configuration adapted to receive said cable, having a laterally extending slot through one leg adjacent the end thereof and a recessed vertical threaded aperature through the opposite leg thereof;

an insulation piercing electrically conductive tap formed at one end to provide an accessory lug disposed through said slot and extending outwardly from said body; and a screw disposed through the end of said tap opposite said accessory lug and threaded into the recessed vertical aperature for mounting said insulation piercing tap within said connector body and for drawing said tap into electrical contact with said cable.

2. A connector as set forth in claim 1 wherein said connector body is provided with a laterally extending hollow projection disposed about said slot to thereby form an insulative housing about the accessory lug of said tap.

* * * * *